US011267156B2

(12) United States Patent
Jensen et al.

(10) Patent No.: US 11,267,156 B2
(45) Date of Patent: Mar. 8, 2022

(54) CUTTING APPARATUS FOR MANUFACTURING BAGS UTILIZING A ROTARY CUTTING DIE

(71) Applicant: Roll-O-Matic A/S, Vissenbjerg (DK)

(72) Inventors: John Buk Jensen, Munkebo (DK); Mads Sandahl Christensen, Copenhagen S (DK)

(73) Assignee: Roll-O-Matic A/S, Vissenbjerg (DK)

( * ) Notice: Subject to any disclaimer, the term of this patent is extended or adjusted under 35 U.S.C. 154(b) by 0 days.

(21) Appl. No.: 17/052,134

(22) PCT Filed: May 1, 2019

(86) PCT No.: PCT/EP2019/061145
§ 371 (c)(1),
(2) Date: Oct. 30, 2020

(87) PCT Pub. No.: WO2019/211325
PCT Pub. Date: Nov. 7, 2019

(65) Prior Publication Data

US 2021/0114246 A1 Apr. 22, 2021

(30) Foreign Application Priority Data

May 2, 2018 (DK) ..... PA201870262

(51) Int. Cl.
*B26F 1/20* (2006.01)
*B26D 7/26* (2006.01)
*B26F 1/44* (2006.01)

(52) U.S. Cl.
CPC ..... *B26F 1/20* (2013.01); *B26D 7/265* (2013.01); *B26D 7/2614* (2013.01); *B26F 1/44* (2013.01)

(58) Field of Classification Search
CPC ..... B26F 1/20; B26F 1/44; B26F 1/24; B26F 3/002; B26D 7/265; B26D 7/2614;
(Continued)

(56) References Cited

U.S. PATENT DOCUMENTS 5,098,238 A * 3/1992 Batchelor ..... B25B 23/00 411/361
5,388,490 A * 2/1995 Buck ..... B26D 7/2628 83/344
(Continued)

FOREIGN PATENT DOCUMENTS

DE 4401300 A1 8/1994
DE 10309174 A1 9/2004
(Continued)

OTHER PUBLICATIONS

International Search Report dated Jul. 8, 2019 in International Application No. PCT/EP2019/061145.
(Continued)

*Primary Examiner* — Jonathan G Riley
(74) *Attorney, Agent, or Firm* — McDermott Will & Emery LLP

(57) ABSTRACT

A cutting apparatus including an apparatus frame and a cutting station, for forming interconnected bags, is provided. The cutting station includes a rotary anvil having an axis of rotation and mounted to a first frame structure, a rotary cutting die disposed adjacent to said rotary anvil and having an axis of rotation parallel to said first axis of rotation, said rotary cutting die including a rotatable cylindrical shaft carrying a die blade, said rotary cutting die being mounted to a frame structure, and an adjustment mechanism for varying the distance between said anvil and said cutting die, said mechanism including a rotatable spindle having threaded portions of different pitch. A first threaded portion engages a threaded portion of said first or said second frame
(Continued)

structure and said second threaded portion engaging a threaded portion of said apparatus frame.

12 Claims, 9 Drawing Sheets

(58) Field of Classification Search
CPC ..... B29C 59/007; B31B 50/005; B31B 50/16; B31B 50/256; B31B 50/88; B31F 1/07; B31F 1/10; B31F 2201/0753; B31F 2201/0794
See application file for complete search history.

(56) References Cited

U.S. PATENT DOCUMENTS 5,412,895 A * 5/1995 Krieger ..... F41A 21/482 42/75.02
5,853,138 A * 12/1998 Chang ..... B26F 1/24 242/525.4
5,935,367 A 8/1999 Hollenbeck
8,622,667 B1 * 1/2014 Seay ..... B23B 51/12 408/239 A
2006/0248999 A1 * 11/2006 Monteil ..... B26D 7/265 83/469
2006/0257193 A1 11/2006 Aichele et al.
2011/0036217 A1 * 2/2011 Schneider ..... B26D 7/20 83/13
2016/0008998 A1 * 1/2016 Denisse ..... B31F 1/07 493/471

FOREIGN PATENT DOCUMENTS

EP 0764505 A1 * 3/1997 ..... B26D 7/265
EP 1710059 A1 10/2006
EP 1721712 A1 11/2006
EP 3147089 A1 3/2017
GB 2273287 A 6/1994
WO 2000023264 A1 4/2000
WO 2015015327 A1 2/2015

OTHER PUBLICATIONS

Written Opinion dated Jul. 8, 2019 in International Application No. PCT/EP2019/061145.
International Preliminary Report on Patentability dated Nov. 3, 2020 in International Application No. PCT/EP2019/061145.

* cited by examiner

CUTTING APPARATUS FOR MANUFACTURING BAGS UTILIZING A ROTARY CUTTING DIE

CROSS-REFERENCE TO RELATED APPLICATIONS

This application is the U.S. National Phase under 35 U.S.C. § 371 of International Patent Application No. PCT/EP2019/061145, filed on May 1, 2019, which in turn claims the benefit of Denmark Patent Application No. PA201870262, filed on May 2, 2018 the entire disclosures of which Applications are incorporated by reference herein for all purposes.

FIELD OF THE INVENTION

The present invention relates to a cutting apparatus for the manufacturing of bags, wherein e.g., a thermoplastic film or other suitable material film, such as film coated paper/foils or of a biodegradable material, is passed between two rotary rollers for making cuts through the film, of the type including an apparatus frame and a cutting station with a rotary anvil mounted to a first frame structure and a rotary cutting die including a rotatable cylindrical shaft carrying a die blade disposed adjacent to the rotary anvil mounted to a second frame structure. The first frame structure or the second frame structure preferably is stationary relative to the apparatus frame, and may even be a part thereof, one of the frame structures being movably supported by the apparatus frame to allow it to be moved towards the other.

BACKGROUND

In one common method for manufacturing plastic bags, an elongated web in the form of a collapsed tube of a thermoplastic film is run in a longitudinal machine direction. The collapsed tube proceeds to a heat sealing station and a cutting station that, respectively, form parallel transverse heat seals at bag-length distances apart and transverse perforation lines defining lines of weakness for individualization of the plastic bags by an end-user, as wells as cut-outs for the purpose of forming a pair of handles in each of the plastic bags, see e.g., WO 00/23264.

An example of a cutting apparatus with such a cutting station includes a rotary cylindrical anvil and a rotary cutting die mounted parallel and adjacent to each other. The rotary cutting die includes a cylindrical shaft and a die blade mounted around the surface of the shaft. As the thermoplastic film passes between the rotary anvil and the rotary cutting die, the die blade of the rotating cutting die contacts and cuts through the plastic material, thereby creating perforations/cuts, see U.S. Pat. No. 5,935,367.

In use of such a cutting apparatus, the die blade is continuously worn, requiring adjustments to ensure the distance between the anvil and the cutting die remains essentially the same, up until the point where the die blade eventually must be replaced. To this end, an adjustment mechanism is provided.

It is, however, a problem that the prior art adjustment mechanisms only allow the operator to carry out a rough adjustment of the distance between the anvil relative and the cutting die; hence, either a substantial over- or under-compensation for wear may result.

SUMMARY

The present invention provides a cutting apparatus with an improved adjustment mechanism whereby an operator may reduce over- or under-compensation for wear by being able to finely adjust the distance between the anvil and the cutting die, when applying—either through a motor or manually—a relatively large control input to the mechanism. In addition, adjustments may conveniently be carried out while the apparatus is running, i.e., when the anvil/cutting die is rotating and processing the film.

More specifically, the aforementioned problems are solved through the use of an adjustment mechanism including a rotatable spindle having a first threaded portion and a second threaded portion, the pitch of the first threaded portion being different, i.e., larger or smaller, from the pitch of the second threaded portion, the first threaded portion engaging a threaded portion of the first or said second frame structure and the second threaded portion engaging a threaded portion of the apparatus frame. This allows fine adjustments, by moving the movable frame structure, of the position of the anvil or the cutter relative to the apparatus frame and, hence, of the distance between the anvil and the cutter die as the die blade is worn. The pitch is the distance along the axis of the spindle that is covered by one complete rotation of the spindle (360°). The adjustment made by the mechanism may of course also be so as to position the anvil in the start position.

Based on a knowledge of die blade wear stored in a computer memory, a motor driving the spindle may perform adjustments automatically from the point a new die blade is put into operation until it must finally be replaced; automated adjustments may also be carried out on the basis of measured machine temperature or other process parameters.

Embodiments of the invention are defined in the appended claims.

In one embodiment, the first frame structure carrying the anvil, or the second frame structure carrying the cutting die, is pivotally connected to the apparatus frame, the other frame structure being fixed relatively to the apparatus frame.

In another embodiment, a spring connected with the apparatus frame supports the first frame structure or the second frame structure. This spring prevents or limits undesired movements resulting from any play, such as within the hinge pivotally coupling the frame structure to the apparatus frame or within the adjustment mechanism proper, whereby the anvil is maintained as close to the cutting die as allowed for by the adjustment mechanism, which balances the force applied by the spring.

Preferably, the mechanism additionally comprises in one embodiment a first part including a motor, the spindle being directly or indirectly driven for rotation by the motor, the threaded portions being arranged next to each other, possibly spaced apart, along the length of the spindle, the second threaded portion being closer to the motor and optionally/preferably having the larger thread pitch, and a second part comprising two internally threaded structures, preferably nuts, engaging a respective one of the threaded portions of the spindle and being fixed against rotation to the first frame structure or to the second frame structure, and to the apparatus frame, respectively, the first threaded portion being distal from the motor and optionally/preferably having the smaller thread pitch. This allows for a construction that may be easily assembled while permitting motor controlled adjustments, with the ability to finely adjust the distance between the anvil and die cutter even with a large motor input rotating the spindle.

In yet another embodiment the spindle comprises a tubular wall, the first threaded portion being formed on the outside thereof and the second threaded portion being formed on the inside thereof, the threaded portion of the first or said second frame structure being internally threaded and the threaded portion of the apparatus frame being externally threaded, the spindle preferably including a manually engageable portion for rotation thereof and the first (outside) threaded portion preferably having a larger thread pitch compared to the thread pitch of the second threaded portion.

DETAILED DESCRIPTION

Figure 1:
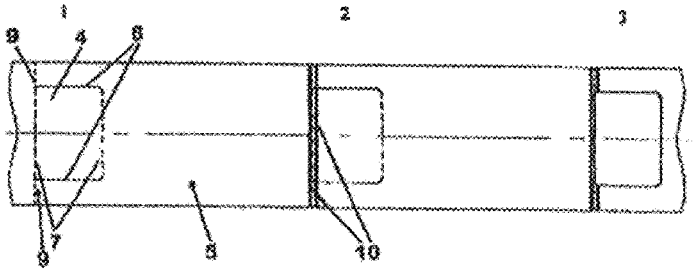
FIG. 1 shows schematically in a top view an elongated web comprising two layers of a thermoplastic film.

FIG. 1 shows three sections 1, 2, 3 of an elongated web 5 comprising two layers of a thermoplastic film, a multiple-step processing being carried out on each section 1, 2, 3 in the course of making plastic bags that, via transverse perforation lines, are connected with each other for subsequent individualization by an end-user. It will be understood that each section 1, 2, 3 has a length corresponding to the length of one plastic bag, and that a rolled-up processed web 5 will have a multiplicity of such sections 1, 2, 3 joined to each other.

On a first web section 1 a first processing may, using the apparatus of the present invention, be effected by applying a cutting pattern defining a handle-forming portion 4 delimited by two parallel cutting lines 6 extending continuously along the length of the web 5 and by two cutting lines 7 that extend transversally to the length of the web 5. The two latter cutting lines 7 may be discontinuous, i.e., in the form of perforations, whereby the material of the portion 4 remains joined to the rest of the web 5, for subsequent removal. Perforation lines 9 may preferably extend from the longitudinally extending cutting lines 6 to the longitudinal edges of the web 5. These perforation lines 9 enable separation of the individual bags from one another. For the second section 2, subsequently established welding lines 10 are shown that extend along a respective side of the perforation line 9.

The invention will now be explained in more detail below by reference to two presently preferred embodiments.

Figure 2:
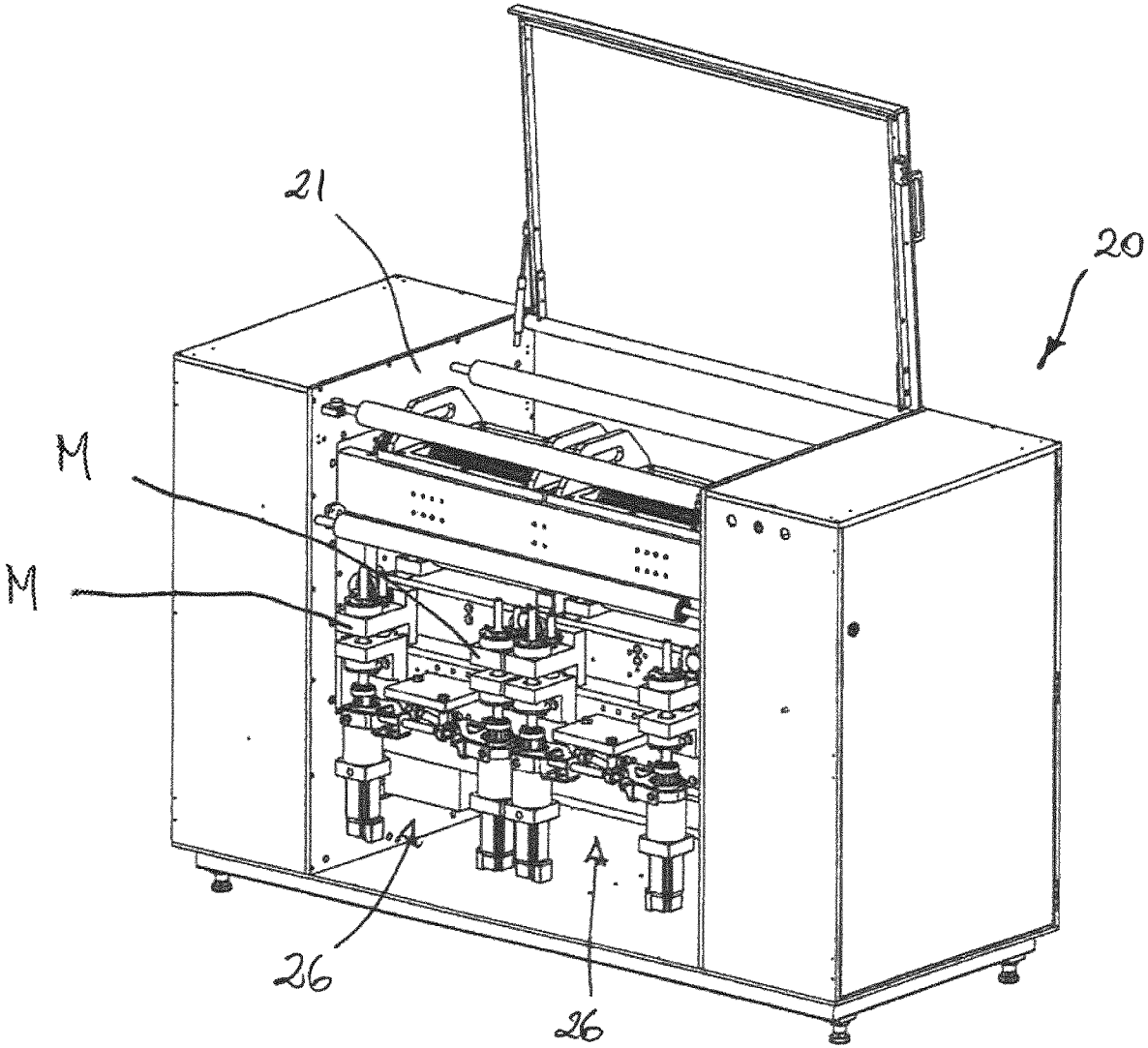
FIG. 2 shows a cutting apparatus with cutting stations incorporating a plurality of adjustment mechanisms according to a first embodiment of the present invention.
Figure 3:
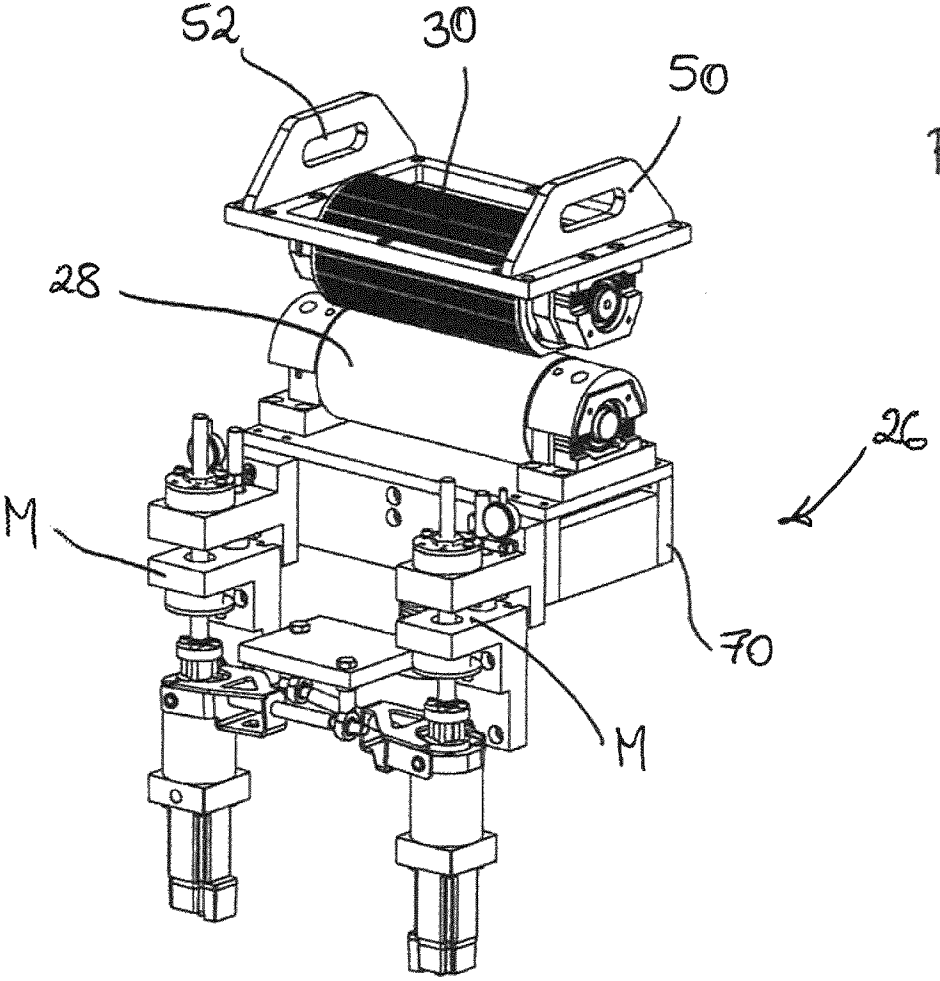
FIG. 3 shows the components of one of the cutting stations of FIG. 2.
Figure 4:
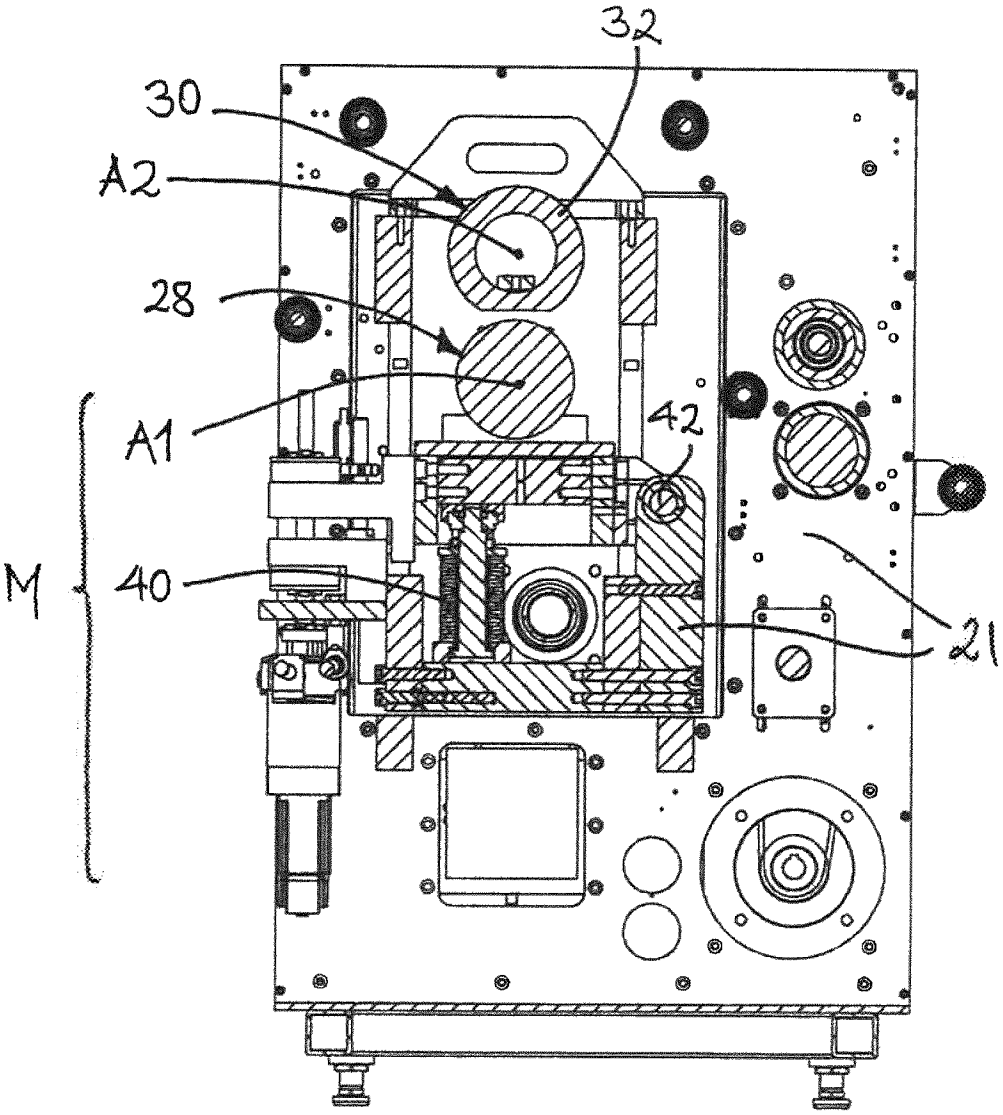
FIG. 4 is a cross-sectional view of the apparatus of FIG. 2.

A cutting pattern as described above may, amongst other cutting patterns, be applied using the cutting apparatus 20 shown in FIG. 2 incorporating a plurality of a first embodiment of an adjustment mechanism M of the present invention. A web (not shown) comprising two layers of a thermoplastic film is continuously supplied to the apparatus 20 at the rear side thereof and exits at the shown front side of the apparatus 20, from which side the web may be continuously supplied to a downstream welding station (not shown) for performing the aforementioned welding. As the skilled person will understand, alternatively the welding station may be located upstream the cutting apparatus 20. In the shown embodiment, the cutting apparatus 20 has two cutting stations 26, 26' located next to each other and carried by the frame 21 of the apparatus 20, each station 26, 26' performing cutting operations on a respective web. FIG. 3 is a view showing the components of one of the cutting stations 26 of the apparatus 20; FIG. 4 is a cross-sectional view of the apparatus of FIG. 2, showing the cutting station 26 of FIG. 3 mounted to the apparatus frame 21.

The cutting station 26 is generally comprised of a driven or free spinning rotary anvil 28 and a driven rotary cutting die 30. The rotary anvil 28 has a first axis A1 of rotation, while the rotary cutting die 30 has a second axis A2 of rotation parallel to the first axis of rotation A1. As indicated by the arrows in FIG. 4, the rotary anvil 28 rotates in a counterclockwise direction about the first axis A1 of rotation, while the rotary cutting die 30 rotates in a clockwise direction about the second axis A2 of rotation. The rotary cutting die 30 is disposed adjacent to the rotary anvil 28 and includes a rotatable cylindrical shaft 32 to the periphery of which a peripheral die blade (not shown) preferably is removably mounted, such as by means of magnetic force or by means of screws, for replacement when fully worn out. Alternatively, the die blade may be integral with the shaft 32. An example of a die blade mounted to the periphery of a cylindrical shaft is shown in U.S. Pat. No. 5,935,367.

In use, the die blade contacts the web and has face portions that cuts through the web 5, as it passes between the rotary anvil 28 and the rotary cutting die 30.

During use of the apparatus 20, the die blade of the cutting die 30 is worn, requiring frequent adjustments of the position of the anvil 28 relative to the cutting die 30, up until the time the die blade is completely worn out. For these adjustments, an improved adjustment mechanism according to the invention is provided, allowing an operator to maintain essentially constant the gap between the anvil 28 and the cutting die 30.

FIG. 3 shows how the rotary cutting die 30 is mounted to a bracket 50, also referred to herein as a second frame structure 50, configured for being supported by the apparatus frame 21 and having handles 52 allowing the rotary cutting die 30 to be removed from the apparatus 21, for service of the bearings supporting the rotary cutting die 30. The anvil 28 is similarly mounted to a bracket 70, also referred to herein as a first frame structure 70, which bracket 70 is pivotally mounted to the apparatus frame 21 at hinge 42, as best seen in FIG. 4, to allow the position of the bracket 70 with the anvil 28 to be adjusted relative to the cutting die 30 through a turning movement, by means of the aforementioned adjustment mechanism, to be described in details in the following.

It is noted that, as shown in FIG. 4, the apparatus 20 additionally may comprise a spring 40 mounted onto the apparatus frame 21 and acting on the bracket 70. This spring 40 holds the bracket 70 against undesired movements resulting from any play at hinge 42 and/or within the adjustment mechanism M, whereby the bracket 70 and, hence, the anvil 28 is maintained as close to the cutting die 30 as allowed for by the adjustment mechanism M, which balances the force applied onto the bracket 70 by the spring 40.

Figure 5:
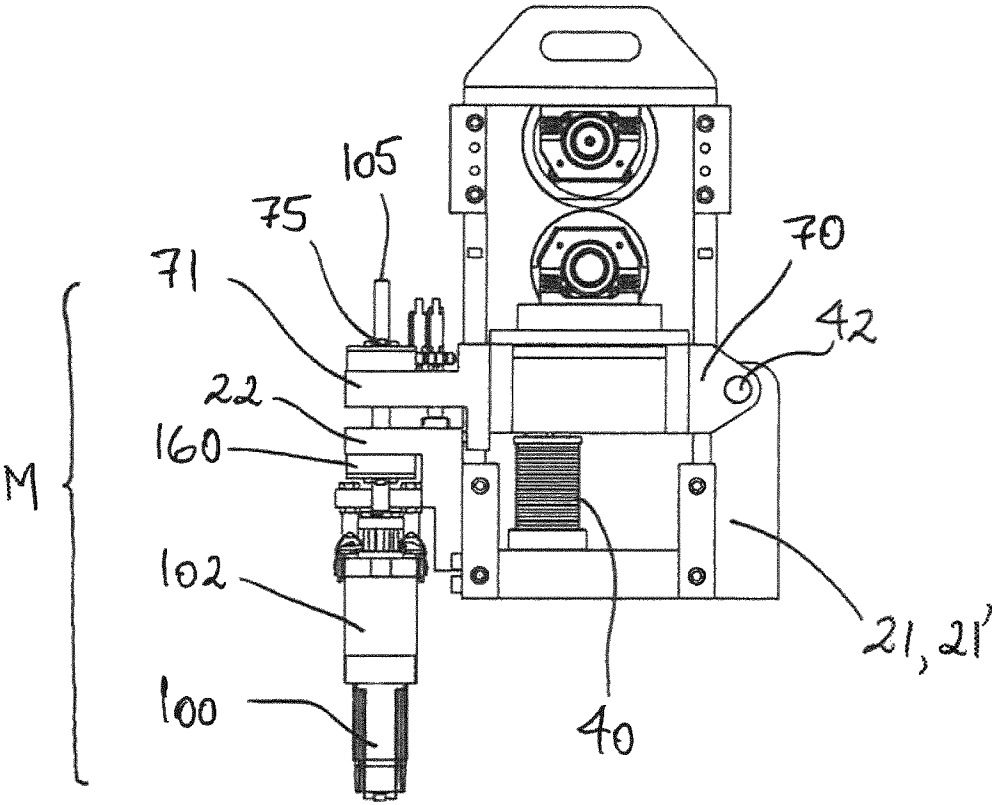
FIG. 5 is an end view of the cutting station shown in FIG. 4, FIGS. 6*a* and 6*b* are perspective and schematic cross-sectional views of the first embodiment of the adjustment mechanism of the invention.

FIG. 5 is an end view of the cutting station 26 of FIG. 4, showing better the components of the first embodiment of the adjustment mechanism M of the invention. Generally, the adjustment mechanism M comprises a first portion including a motor 100, a gear 102 and an elongated cylindrical threaded spindle 105 driven for rotation by the motor 100, preferably by defining an extension of the gear 102 output shaft, and a second portion comprising two nuts 160, 75 or other internally threaded components engaging the spindle 105 and being fixedly mounted respectively to an arm 22 on a frame part 21' of the apparatus frame 21 and to an arm 71 secured to the bracket 70 that carries the anvil 28 and that is pivotally connected to the apparatus frame 21, such as to the frame part 21', at hinge 42. Preferably, this frame part 21' of the apparatus frame 21 also carries the spring 40 engaging the bracket 70.

Figure 6A:
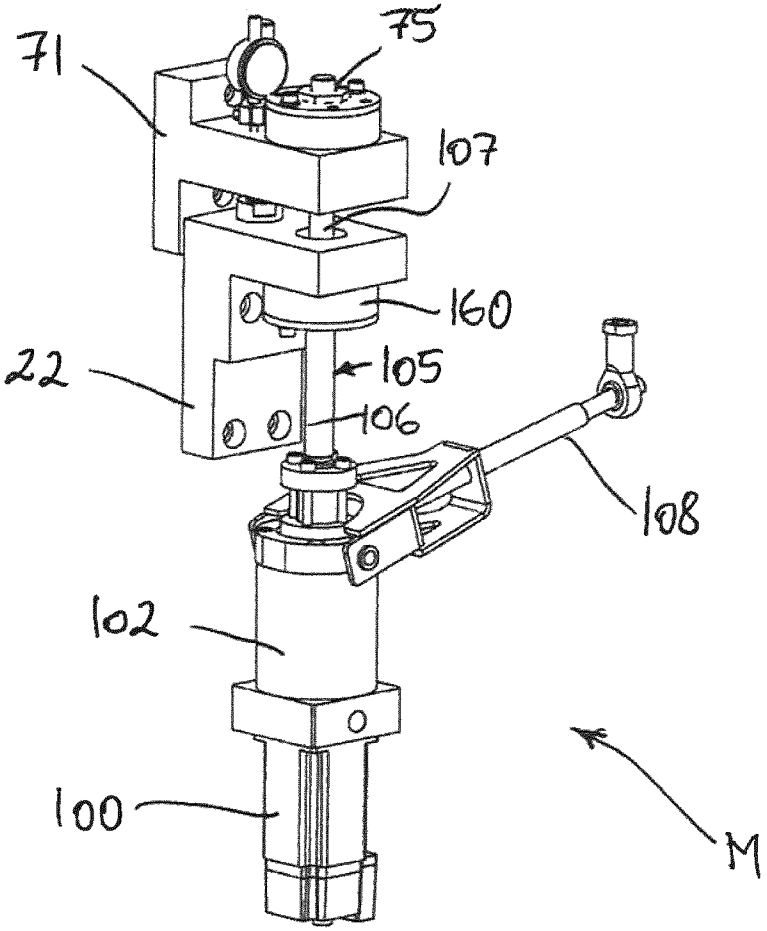

FIG. 6*a* is a perspective view showing better the first embodiment of the adjustment mechanism M and the arms 22, 71 that are connected to the frame part 21' and to the bracket 70, respectively. Preferably, two such mechanisms M are provided, one near a respective end of the bracket 70 carrying the anvil 28, as seen in FIG. 2; this allows independent adjustments to be made where necessary such that the distance between the anvil 28 and the cutting die 30 may vary slightly along the length thereof.

Shown in FIG. 6*a* is also an arm 108 pivotally connected to the gear 102 at one end and to the apparatus frame 21 at the other end. This arm 108 supports the gear 102, the motor 100 and the spindle 105, and allows for up and down movements of the aforementioned first portion of the mechanism M when positional adjustments of the bracket 70 are made in the manner explained below.

The elongated spindle 105 driven for rotation about its longitudinal axis by the motor 100 is threaded along its length, specifically along two lengthwise adjoining portions 106, 107 thereof, the threading of distal portion 107 (e.g., external thread 109) differing from that of portion 106 closer to the motor 100 in 20 having another pitch, preferably a smaller pitch. The internal thread 110 of the nut 75, fixed against rotation to the arm 71, corresponds to the thread pitch of the threaded distal portion 107 of the spindle 105 while the pitch of the internal thread of the nut 160, fixed against rotation to the arm 22, corresponds to the thread pitch of the other portion 106 of the spindle 105. Preferably, all threads of the mechanism M have the same handedness, i.e., are either right-handed or left-handed.

In use, on activation of the motor 100, the spindle 105 rotates about its longitudinal axis, and the engagement with the nuts 75, 160 that are fixed against rotation brings the first portion of the mechanism M to move up or down relative to the fixed arm 22 in accordance with the direction of rotation of the spindle 105, the supporting arm 108 allowing for this movement. With the nut 75 being fixed to the pivotally supported bracket 70 via the arm 71, an up or down turning of the bracket 70 carrying the anvil 28 results.

As will be understood, the thread pitch difference along the spindle 105 causes one full rotation of the spindle 105 to bring about a displacement of the spindle 105 (together with motor 100 and gear 102) relative to the fixed arm 22 which is larger than the displacement/movement of the arm 71 relative to the arm 22, due to the smaller pitch of the portion 107 of the spindle 105 engaging the nut 75 on arm 71. Turning the spindle 105 in one direction gives rise to the spindle moving relative to the nut 160 while the arm 71 will move down relative to the spindle 105 to a lesser extent determined by the thread pitch of portion 107.

Even though the pitch of portion 107 is referred to above as being small, standard pitches may be used, the thread pitch difference along the spindle 105 allowing for small and precise adjustments of the bracket 70 carrying the anvil 28 without the need for careful motor 100 controlling as the pitch variation along the spindle 105 provides for an advantageous gearing. Through the invention, there is no need for costly spindles with a delicate threading requiring careful machining. It is noted that while the use of standard nuts 75, 160 attached to the arms 22, 71 is shown herein, it would alternatively be possible to machine the arms 22, 71 with through-going bores having an internal thread of selected, corresponding pitch and engaging the spindle 105; this option may be preferred where the bracket 70 is linearly movable, in contrast to the shown pivotal journaling at hinge 41 where some skewing of the spindle 105 may occur.

Figure 6B:
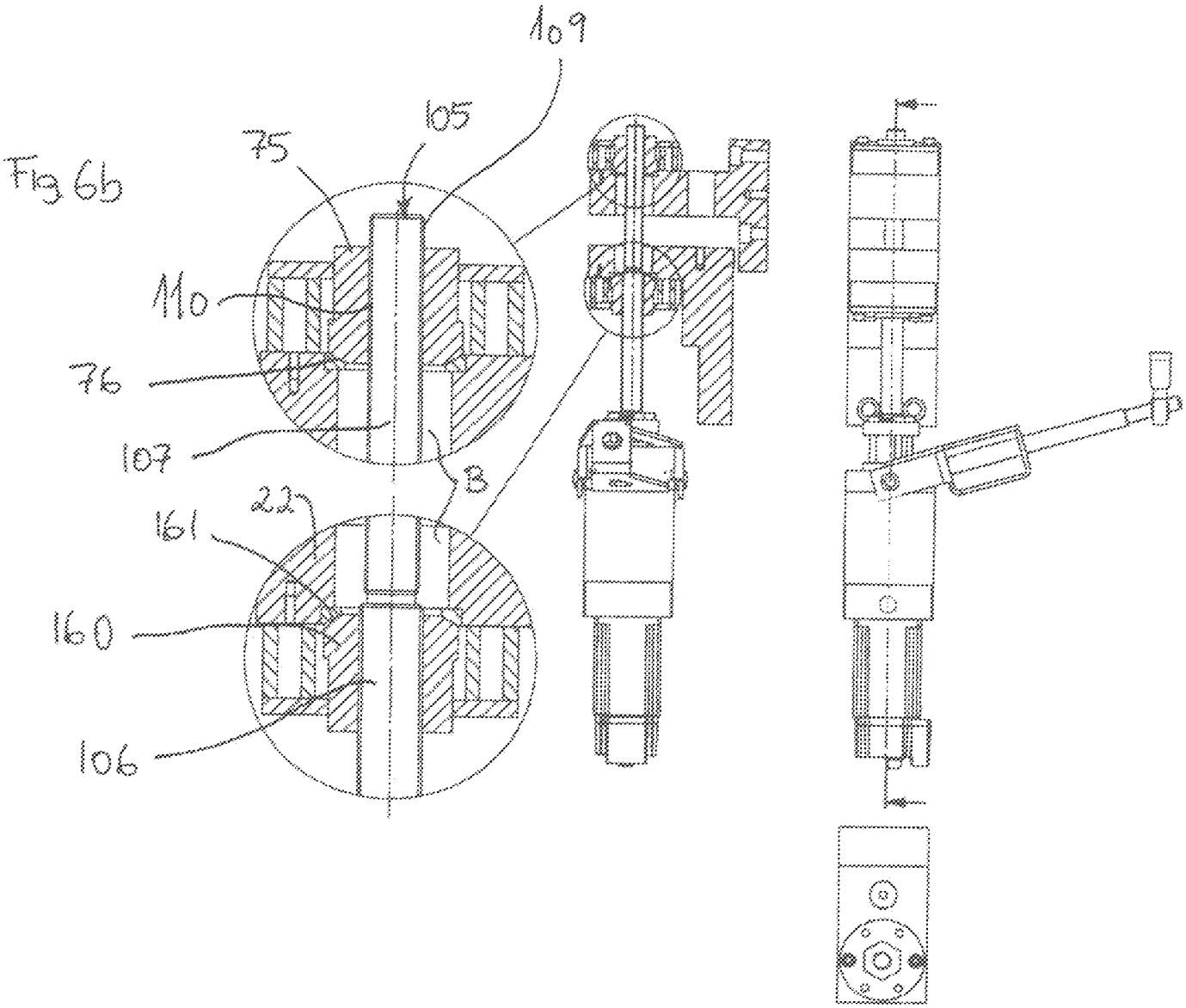

As may be understood, the frame 70 with the anvil 28 is carried by the spindle(s) 105, optionally assisted by a compressed spring 40 that maintains the gap between the anvil 28 and the cutting die 30 to the value determined by the adjustment mechanism M movements, thus minimizing the effect of any play between the parts of the hinge 42 and the spindle 105 and the nuts 75, 160. As shown in FIG. 6*b*, the two nuts 75, 160 that are fixed against rotation may have beveled or rounded end faces 76, 161 resting on correspondingly shaped mating faces on the two arms 22, 71; this allows for the spindle 105 to assume a slightly skewed position as the bracket 70 turns about hinge 42. Typically, position-adjusting movements of the anvil 28 relative to the cutting die 30 to take into account wear of the die blade will be in the order of less than 1 cm, often only a few millimeters, whereby skewing of the spindle 105 will be minimal.

As may also be understood, the proximal and distal portions 106, 107 of the spindle 105 may have different diameters, as shown, and be received in through-going bores B of the arms 22, 71. The diameter variation allows for an easy connection of the mechanism M with the arms 22, 71.

For the shown example, a 1.5 mm thread pitch and a 1.25 mm thread pitch may be selected for the distal portion 107 and proximal portion 106, respectively, resulting in a change in distance between the two nuts 75, 160 of 1.5-1.25=0.25 mm per turn of the spindle 105; in practice M16×1.5 and ¾"UNF may be selected, resulting in a change in distance of 1.5875−1.5=0.085 mm per turn of the spindle, whereby a relatively high number of turns of the spindle 105 is required for any significant adjustment of the position of the anvil 28 relative to the die 30 is required.

While in the foregoing the mechanism M has been explained in connection with an embodiment wherein the mechanism acts on the anvil 28, being in this embodiment the movable part, the skilled person will understand that the mechanism M may equally act on the die cutter 30 being the movable part, with the anvil 28 being fixed relative to the apparatus frame 21.

Figure 7A:
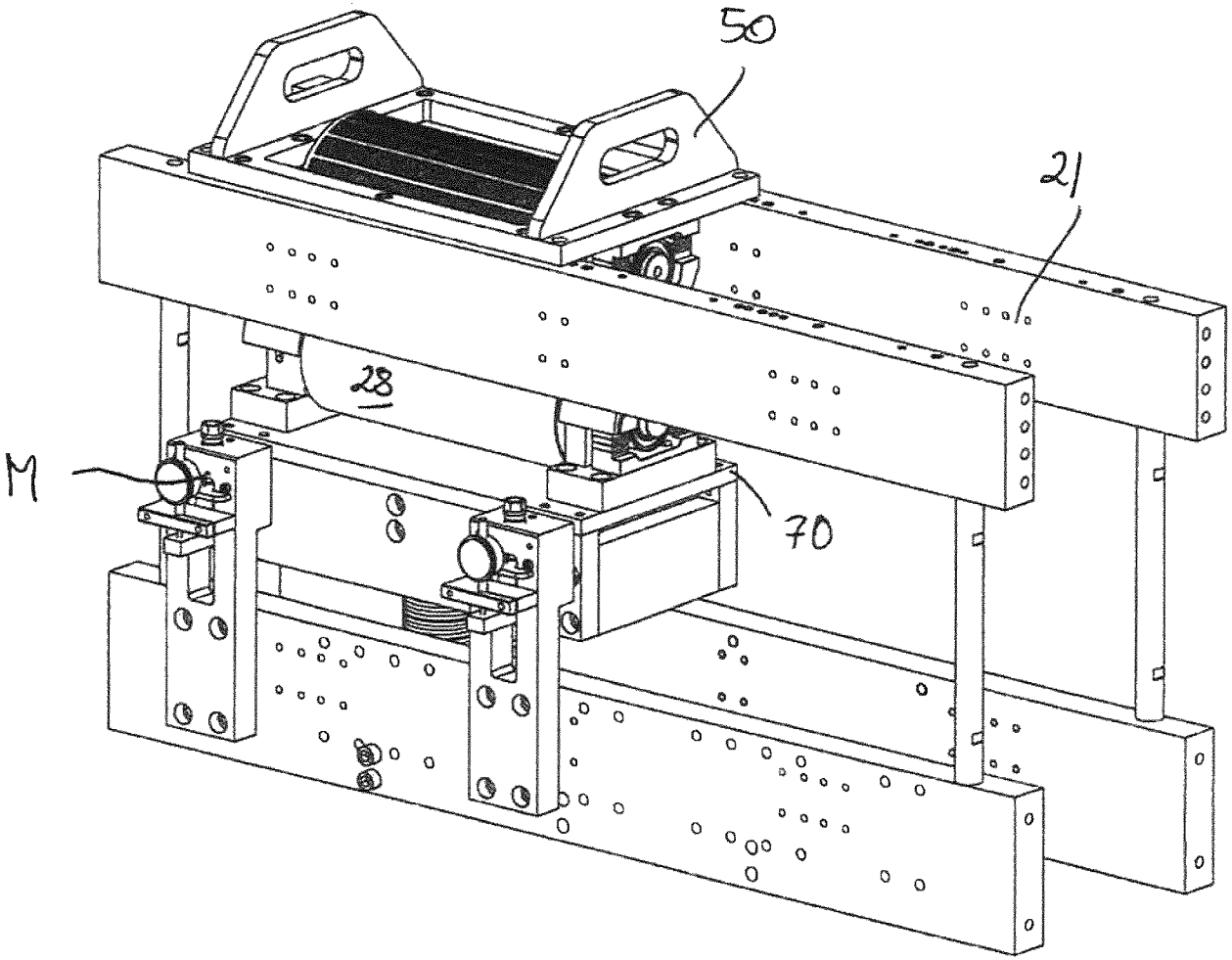
FIGS. 7*a* and 7*b* are perspective and cross-sectional views of a second embodiment of the adjustment mechanism of the invention.
Figure 7B:
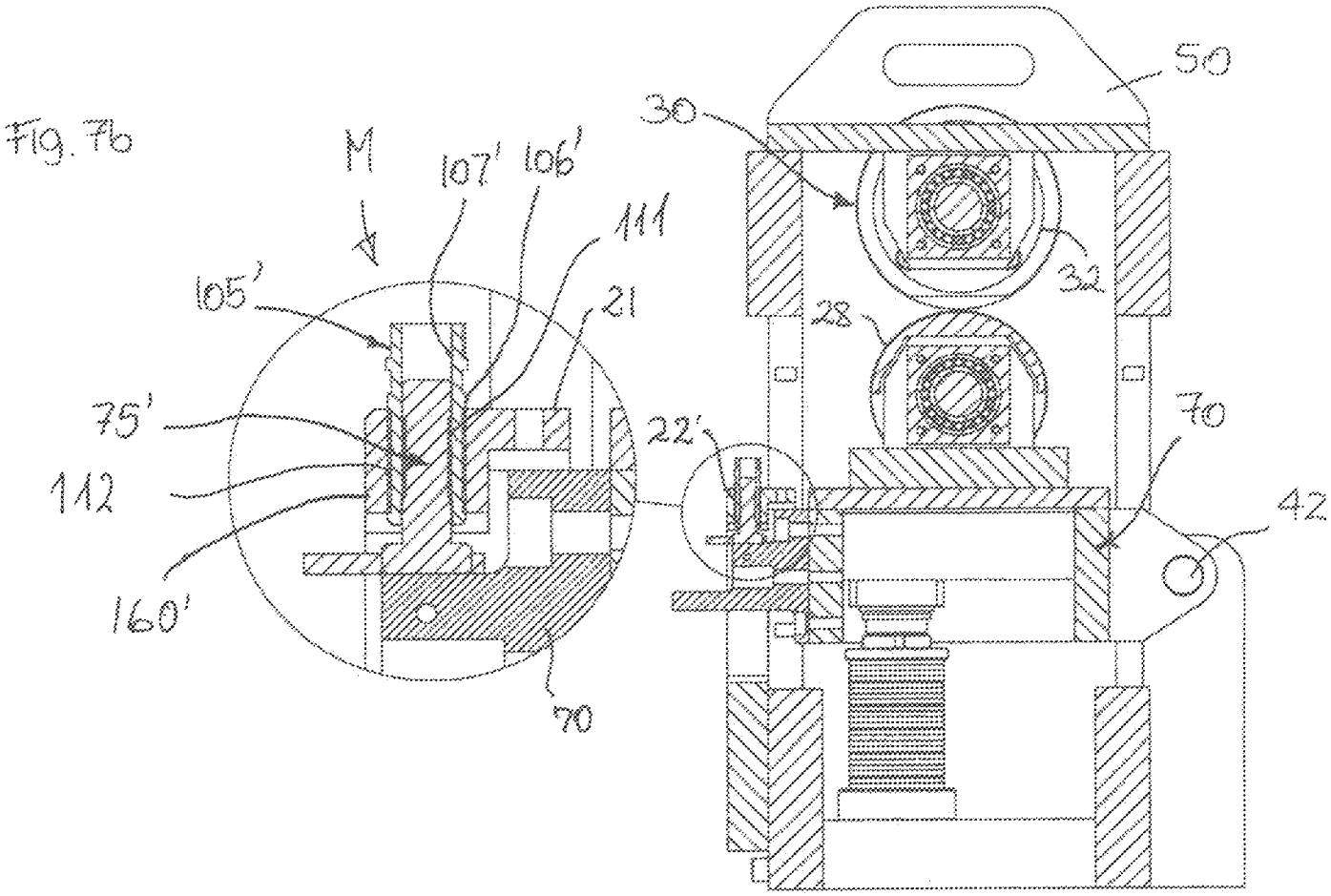

FIGS. 7*a* and 7*b* show an embodiment of the cutting apparatus, including an alternative mechanism 15 M wherein adjustment is done manually, in contrast to the first embodiment wherein adjustment is made through activation of the motor M. In this alternative mechanism, the spindle 105' comprises a cylindrical tubular wall, a first threaded portion 107' being formed on the inside of the wall and a second threaded portion 106' being formed on the outside of the wall. Here, the internally threaded component/portion 160' is exemplified as an integral part of the apparatus 20 frame 21, being internally threaded with a thread pitch corresponding to that of the second (outside) threaded portion 106', and the threaded component/portion 75' (cf. external thread 111) of movable frame structure 70 is a bolt-like structure externally threaded with a thread pitch corresponding to that of the first (internal) threaded portion 107' of the spindle 105'. The spindle 105' includes a manually engageable end portion for rotation of the spindle 105'. Preferably, the second (outside) threaded 25 portion 106' of the spindle 105' has the larger thread pitch compared to the thread pitch of the (internal) first threaded portion 107'.

While in the previous description the mechanism M has been described for use in connection with a cutting apparatus including a rotary anvil 28 and a rotary cutting die 30, the skilled person will understand that such a mechanism M may also find use in the context of a cutting device of the general type disclosed in W02015/015327 (Amutec S. R. L.) where the web is run in a stop-and-go punching procedure in a passage between an abutment and a movable bar/structure carrying the die blade. Applicant reserves the right to draw up claims, such as for a divisional patent application, directed also to a plastic bag forming cutting apparatus with an apparatus frame 21 having an abutment mounted to a first frame structure and a bar/structure carrying a die blade mounted to a second frame structure, the first or the second frame structure being movable, and including the adjustment mechanism M according to the present invention, for varying the distance between said abutment and said bar, the mechanism M including a rotatable spindle 105, 105' having a first threaded portion 107, 107' and a second threaded portion 106, 106', the thread angle of said first threaded portion 107, 107' being different from the thread angle of said second threaded portion 106, 106', the first threaded portion 107, 107' engaging a threaded portion 75, 75' of said first or said second frame structure 50, 70 and said second threaded portion 106, 106' engaging a threaded portion 160, 160' of said apparatus frame 21, with all the appended dependent claims depending thereon.

The invention claimed is:

1. A cutting apparatus including a stationary apparatus frame and a cutting station supported on said stationary apparatus frame, for forming interconnected bags, such as interconnected along transverse lines of weakness, said cutting station comprising:

a rotary anvil having a first axis of rotation and mounted to a first frame structure;

a rotary cutting die disposed adjacent to said rotary anvil and having a second axis of rotation substantially parallel to said first axis of rotation, said rotary cutting die including a rotatable cylindrical shaft carrying a die blade, said rotary cutting die being mounted to a second frame structure; and an adjustment mechanism for varying a distance between said rotary anvil and said rotary cutting die, said adjustment mechanism including a rotatable spindle having a first threaded portion and a second threaded portion, wherein a pitch of said first threaded portion being different from a pitch of said second threaded portion, wherein:

said first threaded portion is configured to engage a threaded portion of said first or said second frame structure and said second threaded portion is configured to engage a threaded portion of said stationary apparatus frame.

2. The cutting apparatus of claim 1, said first frame structure or said second frame structure being pivotally connected to said apparatus frame.

3. The cutting apparatus of claim 1 further comprising a spring connected with said apparatus frame supporting said first frame structure or said second frame structure.

4. The cutting apparatus of claim 1, said adjustment mechanism additionally comprising a first part including a motor, said rotatable spindle being directly or indirectly driven for rotation by said motor, said threaded portions being arranged next to each other along a length of said rotatable spindle, said second threaded portion being closer to said motor.

5. The cutting apparatus of claim 4, wherein said first threaded portion is distal from said motor and engages said one internally threaded structure fixedly mounted against rotation to said first frame structure or to said second frame structure.

6. The cutting apparatus of claim 1, said rotatable spindle comprising a tubular wall, said first threaded portion being formed on the inside of said tubular wall and said second threaded portion being formed on the outside of said tubular wall.

7. The cutting apparatus of claim 6, said threaded portion of said first or said second frame structure being externally threaded and said threaded portion of said apparatus frame being internally threaded.

8. The cutting apparatus of claim 6, said rotatable spindle including a manually engageable portion for rotation of said rotatable spindle.

9. The cutting apparatus of claim 6, said first threaded portion having a thread pitch that is smaller than the thread pitch of said second threaded portion.

10. The cutting apparatus according to claim 1, including a a second adjustment mechanism for adjustment of said distance between said rotary anvil and said rotary cutting die.

11. The cutting apparatus of claim 1, further comprising a a first internally threaded structure engaging a respective one of said threaded portions of said rotatable spindle and being fixed against rotation to said first frame structure or to said second frame structure, and a second internally threaded structure engaging another of said threaded portions of said rotatable spindle, and being fixed against rotation to said apparatus frame.

12. The cutting apparatus of claim 4, wherein said first threaded portion is distal from said motor and has a smaller thread pitch.

* * * * *